US007225804B2

(12) United States Patent
Simmons, Jr. et al.

(10) Patent No.: US 7,225,804 B2
(45) Date of Patent: Jun. 5, 2007

(54) MOTOR DRIVEN OVEN DOOR LATCH

(75) Inventors: Charlie Bruce Simmons, Jr., New Bern, NC (US); Manfred Staebler, New Bern, NC (US)

(73) Assignee: BSH Home Appliances Corporation, Huntington Beach, CA (US)

( * ) Notice: Subject to any disclaimer, the term of this patent is extended or adjusted under 35 U.S.C. 154(b) by 176 days.

(21) Appl. No.: 10/987,628

(22) Filed: Nov. 12, 2004

(65) Prior Publication Data

US 2006/0102166 A1 May 18, 2006

(51) Int. Cl.
*F23C 15/04* (2006.01)

(52) U.S. Cl. ..... 126/197; 292/111; 126/273 R

(58) Field of Classification Search ..... 126/197, 126/191, 192; 292/111, DIG. 69
See application file for complete search history.

(56) References Cited

U.S. PATENT DOCUMENTS 4,374,320 A * 2/1983 Barnett ..... 219/413
4,623,179 A 11/1986 Davis et al.
4,866,955 A 9/1989 Blair et al.
5,015,827 A * 5/1991 Kadwell et al. ..... 219/497
5,068,554 A * 11/1991 Mohn ..... 310/12
5,197,375 A * 3/1993 Rosenbrock et al. ..... 99/328
5,220,153 A 6/1993 Malone et al.
5,293,020 A 3/1994 Han et al.
5,838,125 A 11/1998 Choi
6,079,756 A 6/2000 Phillips
6,177,771 B1 1/2001 Kinzer et al.
6,302,098 B1 * 10/2001 Smith ..... 126/197
6,709,029 B2 3/2004 Cole

* cited by examiner

*Primary Examiner*—Josiah Cocks
*Assistant Examiner*—Sarah E. Suereth
(74) *Attorney, Agent, or Firm*—Russell W. Wamock; Craig J. Loest

(57) ABSTRACT

A simple, highly reliable automatic motor driven oven door latch for an oven self-cleaning operation. To ensure that the motor has operated correctly and has not stopped in a null position, the motor is provided with a start pulse and the location of the latch or locking member of the latching mechanism is monitored to guarantee that the locking member has moved to the correct position. If the locking member has not moved to the correct position, then the motor is provided with another start pulse and the location of the latch or locking member of the latching mechanism again is monitored to again ensure that the locking member has moved to the correct position. This sequence can be repeated on opening and closing of the latching mechanism a desired number of times to guarantee that the locking member has moved to the correct position when locking or releasing the oven door.

19 Claims, 7 Drawing Sheets

MOTOR DRIVEN OVEN DOOR LATCH

BACKGROUND OF THE INVENTION

1. Field of the Invention

The present invention generally relates to ovens or ranges and, in particular, to a motor driven door latch for self-cleaning ovens or ranges.

2. Discussion of the Prior Art

So-called self-cleaning or pyrolytic ovens or ranges (hereinafter ovens for simplicity) require high temperatures to burn or vaporize the cooking residues left in the oven chamber. It is conventional to add a locking latch device to the oven to lock the door closed during the self-cleaning operation to prevent accidental or inadvertent opening of the door by a user. In general these latch devices include some type of moving a latch arm into engagement with the oven door to lock the door closed for the self-cleaning operation. The latch device is released upon the completion of the self-cleaning operation, which is generally either time based or based upon the sensed temperature in the oven.

One attempt to eliminate this inadvertent opening of the oven door included a manual actuated latch, such as an actuating handle or a lever to rotate the latch to the closed or latched position. There are a number of types of such manual devices and some include bolt type mechanisms.

Later attempts to provide the latching mechanism, include various types of automatic or electrically operated motor or solenoid driven latch mechanisms. These mechanisms often are expensive and can be unreliable. Reliability of the locking latch mechanism is of great concern due to the high cleaning temperatures in the oven and consequently also is a UL requirement.

It would be desirable to provide an automatic motor driven door latch for an oven, which is simple, inexpensive and highly reliable.

BRIEF SUMMARY OF THE INVENTION

The present invention provides a simple, highly reliable automatic motor driven oven door latch for an oven self-cleaning operation. The present invention also substantially eliminates the danger of a mistaken opening of the oven due to a failed latch operation, which does not fully engage in the locked position.

The oven door latch utilizes an asynchronously driven motor for reducing costs in the latching mechanism. To ensure that the motor has operated correctly and has not stopped in a null position, the motor is provided with a start pulse and the location of the latch or locking member of the latching mechanism is monitored to guarantee that the locking member has moved to the correct position. If the locking member has not moved to the correct position, then the motor is provided with another start pulse and the location of the latch or locking member of the latching mechanism again is monitored to guarantee that the locking member has moved to the correct position. This sequence can be repeated on opening and closing of the latching mechanism to guarantee that the locking member has moved to the correct position when opening or closing.

The present invention will now be explained in greater detail herein below in terms of an embodiment with reference to the drawings. The drawings illustrate a schematic and diagrammatic representation of the essential components of a motor driven oven door latch, as it can be arranged in an oven according to the present invention.

DETAILED DESCRIPTION OF THE INVENTION

Figure 1:
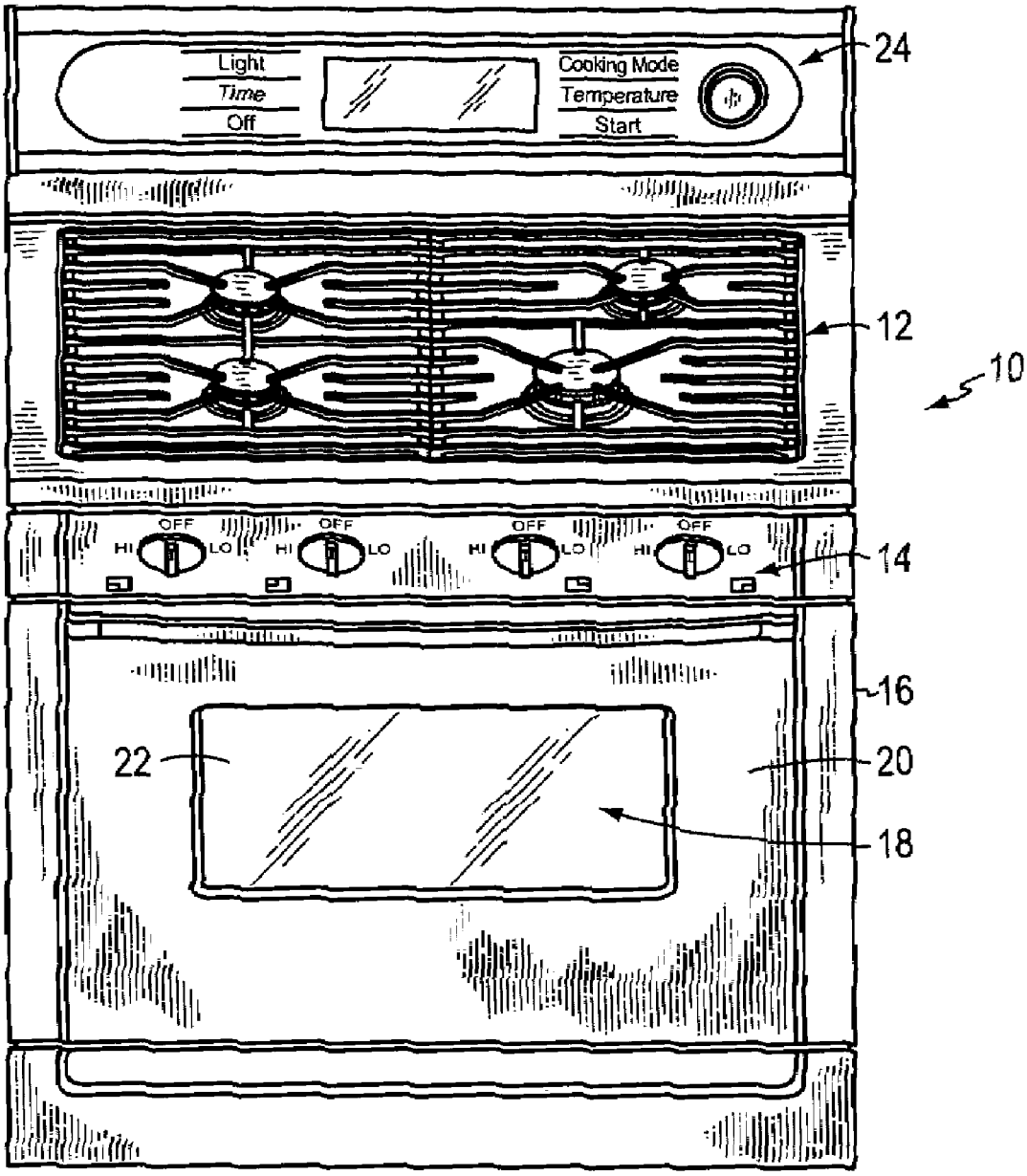
FIG. 1 illustrates a perspective view of a gas oven in which the motor driven oven door latch of the present invention can be utilized.

Referring now to FIGS. 1–4, a gas oven 10 includes a gas range 12 and an associated control panel 14 for the burners of the oven or range 10. The type of cooking apparatus, generally referred to as an oven or range is not significant and can be an electric or gas or dual fuel oven (oven is used for ease of reference hereinafter) and a free standing range as illustrated or a built in oven (not illustrated). The oven 10 includes a frame 16, with an oven chamber 18 in the lower portion thereof below the gas range 12 as is conventional when such a range 12 is included in the oven 10. The oven chamber 18 is closed by an oven door 20, which generally includes or can include a window 22 for the user to view the inside of the chamber 18, such as to view food cooking in the chamber 18. The operation of the oven chamber 18 is controlled by the user utilizing a second control panel 24. The self-cleaning operation of the oven chamber 18 is controlled by operation of the control panel 24 as hereinafter described.

Figure 2:
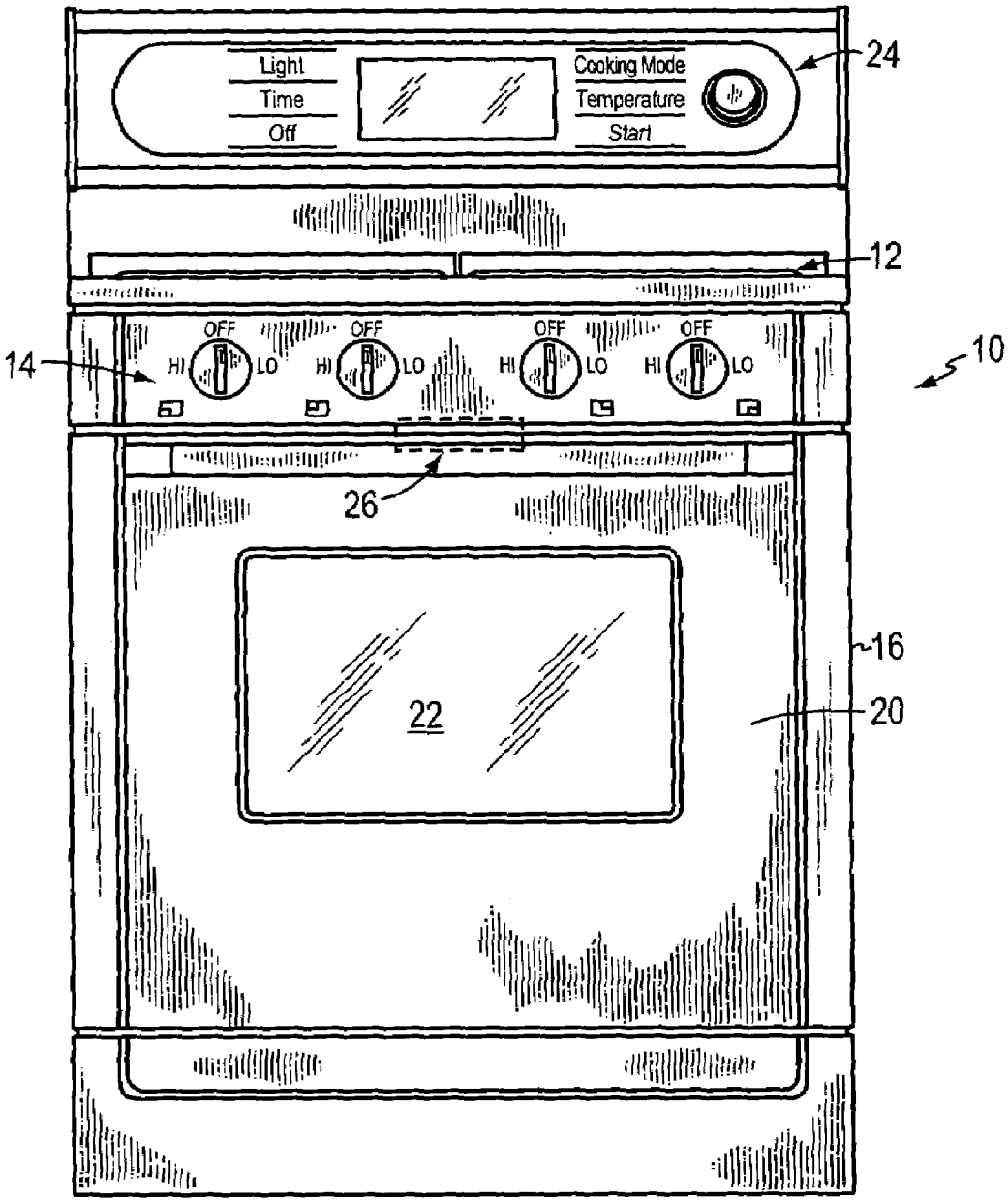
FIG. 2 illustrates a front plan view of the oven of FIG. 1 including a schematic illustration of one location of the door latch of the present invention.
Figure 3:
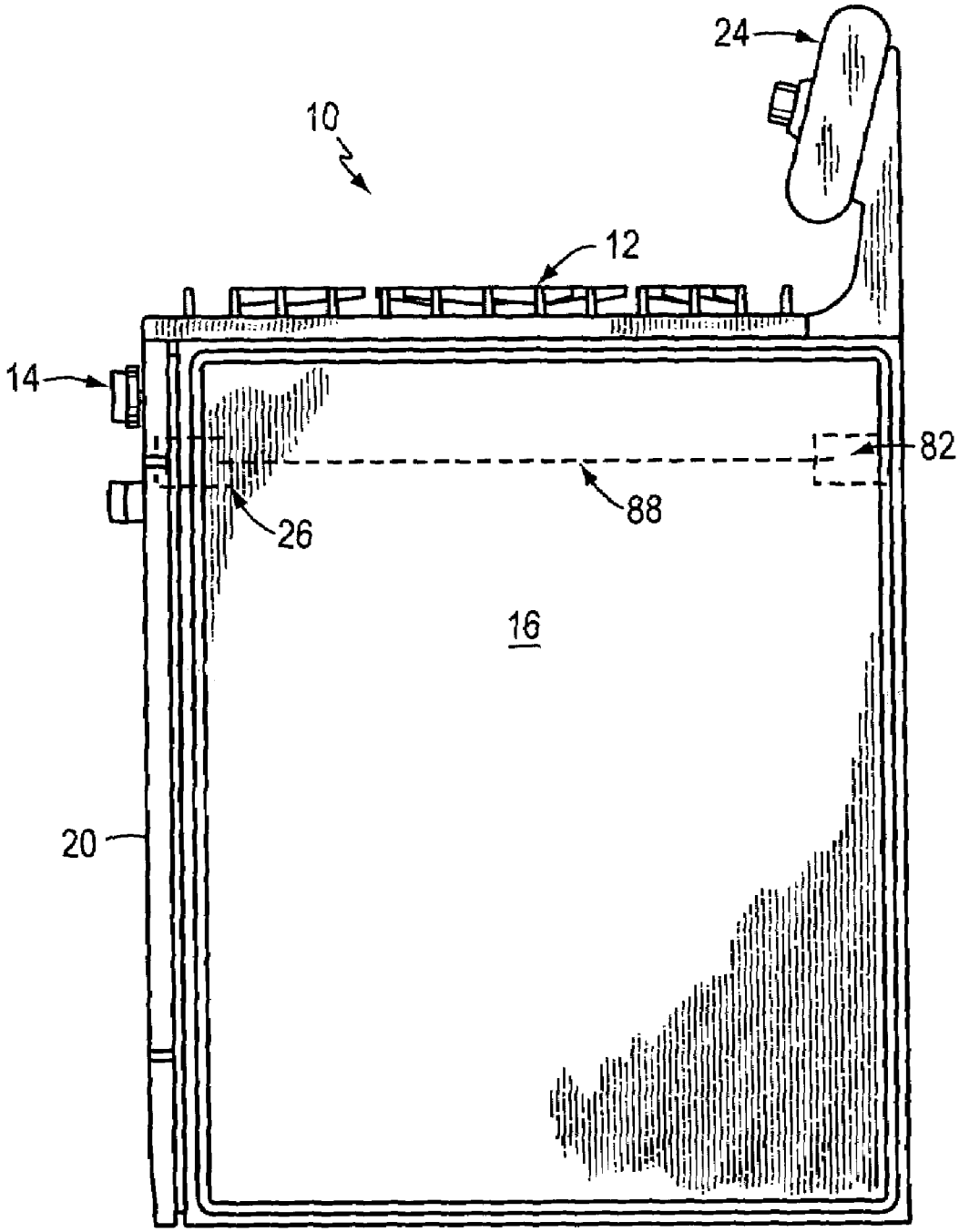
FIG. 3 illustrates a side plan view of the oven of FIG. 1 including a schematic illustration of one location of the door latch of the present invention.
Figure 4:
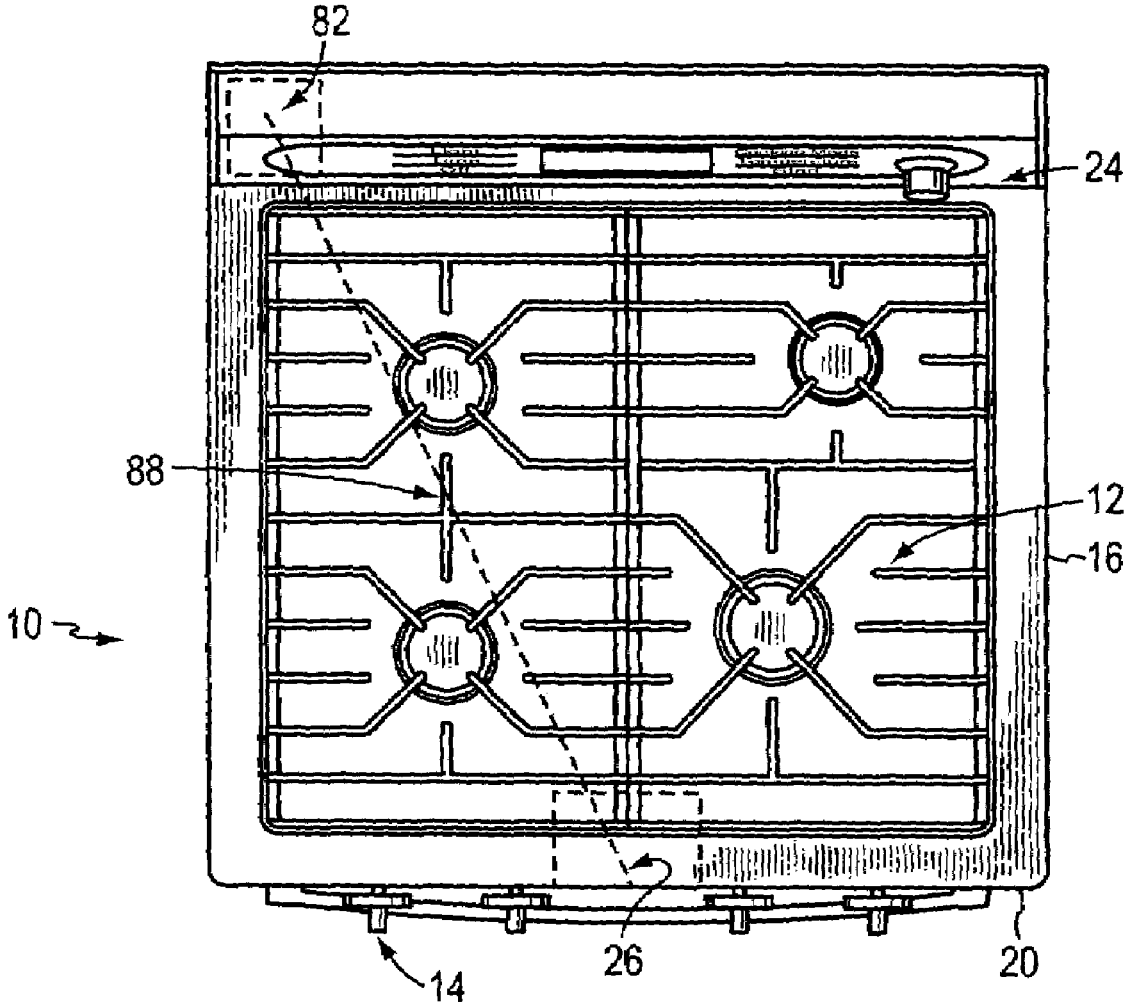
FIG. 4 illustrates a top plan view of the oven of FIG. 1 including a schematic illustration of one location of the door latch of the present invention.

One central location of the door latch of the present invention, designated generally by a dashed line representation 26 is generally illustrated, not to scale, in FIGS. 2–4. The central location 26 is generally the most conventional location for a latch mechanism, generally represented by the reference numeral 30. (Referring now to FIGS. 5 and 6 the operation and details of the motor driven oven door latch or latch mechanism 30 (hereinafter door latch) of the present invention is illustrated. The door latch 30 preferably is mounted on a plate or frame 32, of no particular shape or configuration. The plate 32 then is fixedly mounted (not illustrated) to the oven frame 16 in the location 26. The oven door 20 is partially illustrated and includes an inner surface or wall 34 shown only as a line for illustration purposes. The inner surface or wall 34 includes a locking slot 36 in a middle region thereof. The door latch 30 includes a latch or lock arm 38 pivotably mounted by a bolt or pin 40 to the plate 32. The lock arm 38 includes a hook or L-shaped member 42 which is aligned with and movably fits through the locking slot 36 to allow the door 20 to be opened and closed in a non-cleaning mode of operation.

Figure 6:
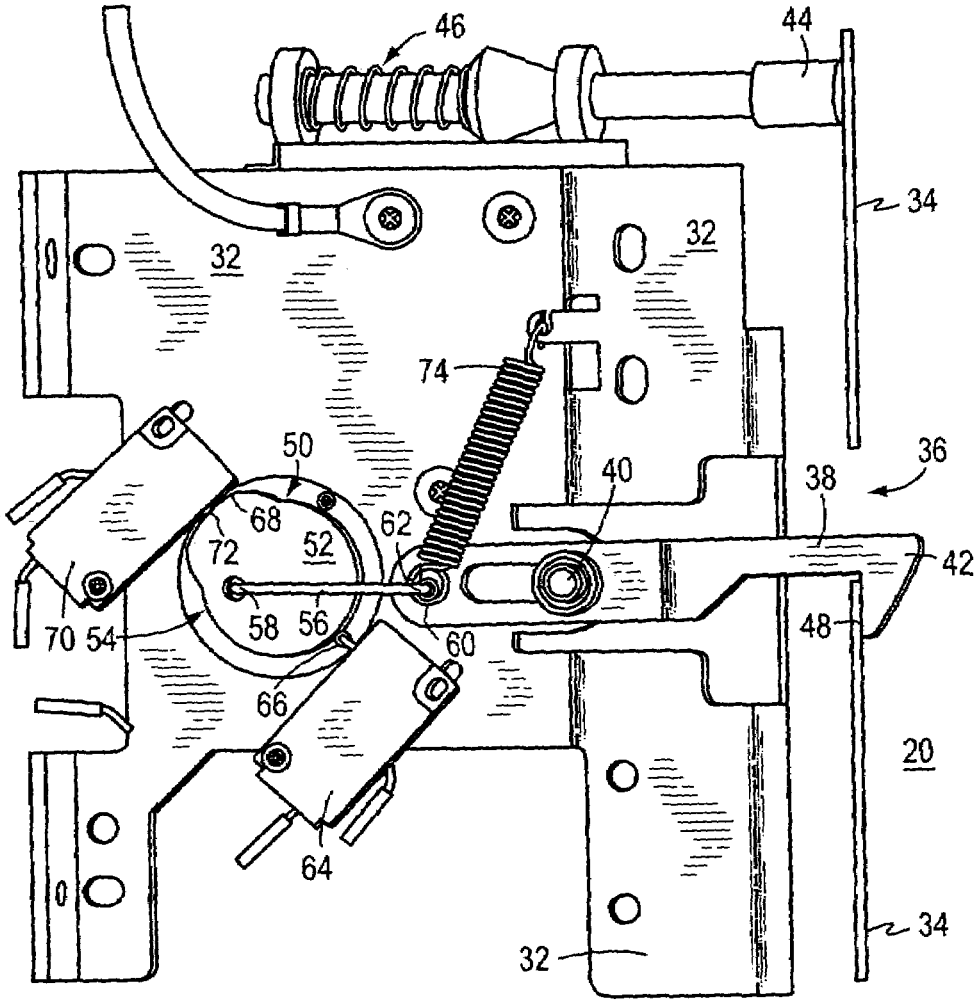
FIG. 6 illustrates a top plan view of the embodiment of the door latch of FIG. 5 in a locked or closed position.

When the door 20 is in the closed position, as illustrated in FIG. 6, a pin 44 which is biased by a spring 46 into the extended position when the door 20 is open, is depressed by the wall 34 and indicates to the oven 10 that the door 20 is closed. The location of the pin 44 also can conveniently be utilized to operate a light (not illustrated) in the oven chamber 18, turning on when the door 20 is opened to release the pin 44 and turning off when the door 20 is closed and the pin 44 is depressed. Once this indication is received by the control panel 24, then the self-clean operation can be initiated by the user. The latch 30 also could include an interlock mechanism, which will not allow the latch 30 to operate unless the door 20 is in the closed position.

Figure 5:
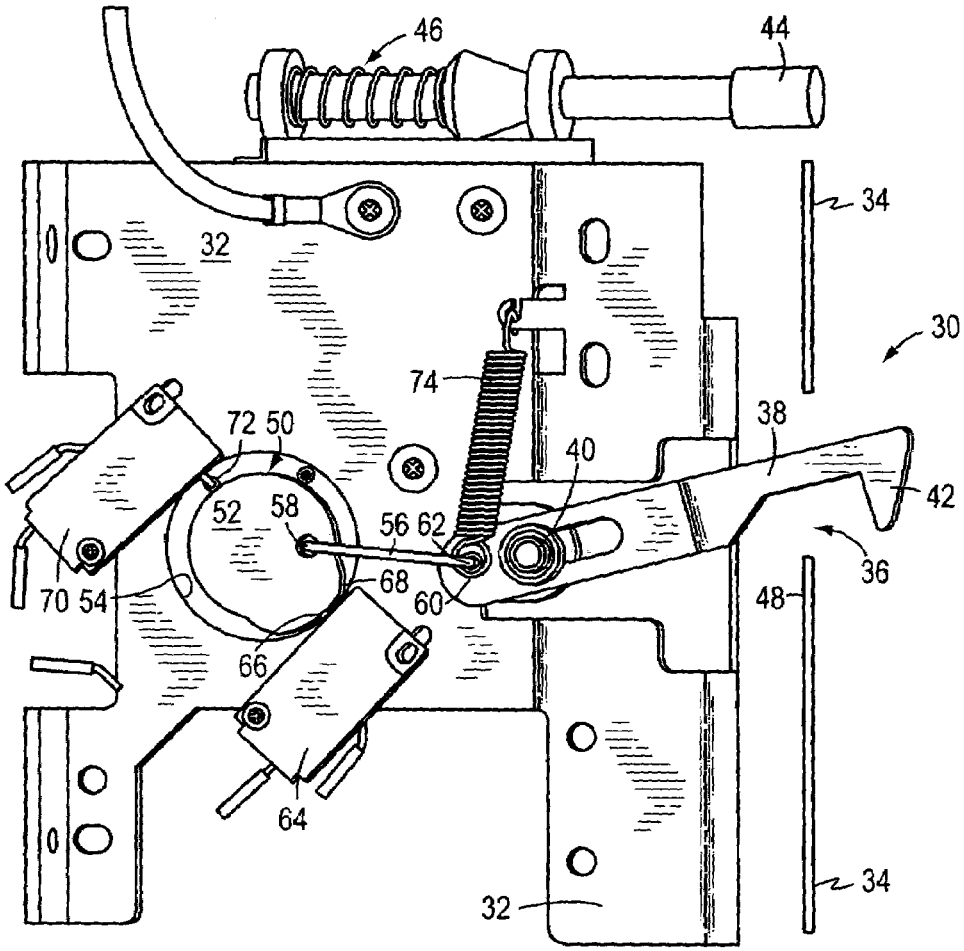
FIG. 5 illustrates a top plan view of one embodiment of the door latch of the present invention in an unlocked or open position.

When the self-clean operation is initiated, the lock arm 38 hook 42 is moved rearwardly and downwardly (as illustrated for reference in FIGS. 5 and 6) to engage an inside edge 48 of the locking slot 36, as illustrated in FIG. 6. This locks the door 20 in a closed position for the duration of the self-cleaning mode of operation. When the operation is ended, the lock arm 38 hook 42 is moved outwardly and upwardly (as illustrated for reference in FIGS. 5 and 6) to release the inside edge 48 of the locking slot 36 to a position where the latch 30 moves freely into and out of the slot 36, as illustrated in FIG. 5. This releases the door for normal opening and closing by the operator. The shape and configuration of the hook 42 is not critical and can vary as desired as long as the locking latch function is maintained by the configuration of the hook 42 and the door edge 48 or other door structure to which the hook 42 will engage.

An asynchronously driven motor 50 is mounted to the plate 32 on the opposite side or back side as illustrated in FIGS. 5 and 6. The asynchronously driven motor is chosen, because it is very inexpensive, but could be replaced by a DC motor for speed of operation or a stepper motor if desired. A cam 52 made of heat resistant material is molded or otherwise mounted to the motor shaft (not illustrated) and extends through an aperture or opening 54 in the plate 32. Referring to FIG. 5, the unlatched or door released position is illustrated for the door latch 30. The cam 52 includes an offset arm or hook 56 pivotally mounted to the cam 52 at a first end 58 and pivotally mounted to an opening 60 in the lock arm 38 opposite the hook 42 in a second end 62 of the arm 56. The open position is monitored by the control panel 24 by the state of a switch 64. The switch 64 also is selected to meet the necessary temperature rating and can be any type of switch, which provides the required functions. The cam 52 rotates as the motor 50 is actuated and includes a cam portion 68, which rotates and depresses an actuation pin 66 in the switch 64 when the lock arm 38 is in the fully released or open position. The control panel 24 monitors the switch 64 after the motor 50 is actuated to ensure that the pin 66 is moved to actuate the switch 64 to ensure that the motor 50 is not stuck in a null position. If after actuation the switch 64 is not activated by the pin 66, then the motor 50 is pulsed again until the switch 64 is activated by the cam surface 68 to guarantee that the latch 30 and the door 20 have been released.

When the self-clean operation is initiated, the lock arm 38 is moved into the locked position as illustrated in FIG. 6 by the rotation of the motor 50 (which in the example illustrated is counter-clockwise). As the cam portion 68 rotates away from the switch 64, the pin 66 is released and the switch 64 is unactivated. If upon pulsing the motor 50, the switch 64 remains activated, then the cam surface 68 has not rotated and the motor 50 then is pulsed again. Once the switch 64 is unactivated, then the control panel 24 monitors a second switch 70, which also has an actuation pin 72 like the switch 64. Once the pin 72 is depressed by the cam surface 68, then the switch 70 is activated signalling the control panel 24 that the hook 42 is engaged with the slot edge 48 and the door 20 is locked for the self-cleaning operation. The lock arm 38 can include a bias spring 74 to aid in the rotation of the arm 38. The motor 50 is energized and then if the switch 64 remains activated, the motor is de-energized for a period and then re-energized to provide a second pulse to the motor 50. The motor 50 can receive a set number of pulses, such as five (5) before the oven 10 will generate an alarm through the control panel 24 to indicate a motor failure.

In another embodiment (not separately illustrated for this description, but see FIG. 7), the self-clean operation also can be accomplished with the door latch 30, but with only one switch, such as the switch 70 for example. In this embodiment, for example purposes, the door latch 30 includes the same mechanism as illustrated in FIGS. 5 and 6, with FIG. 6 used for descriptive purposes. Again, when the self-clean operation is initiated, the lock arm 38 is moved into the locked position as illustrated in FIG. 6 by the rotation of the motor 50 (which in the example illustrated is counter-clockwise). The control panel 24 monitors the switch 70 and the actuation pin 72. Once the pin 72 is depressed by the cam surface 68, then the switch 70 is activated signalling the control panel 24 that the hook 42 is engaged with the slot edge 48 and the door 20 is locked for the self-cleaning operation. The open position also is monitored by the control panel 24 by the state of a switch 70. When the self-clean operation is terminated the door latch 30 is released. Once the pin 72 is released from the cam surface 68 as the motor 50 rotates, then the switch 70 is deactivated signalling the control panel 24 that the hook 42 is released from the slot edge 48 and the door 20 is open for regular operation of the oven 10.

Figure 7:
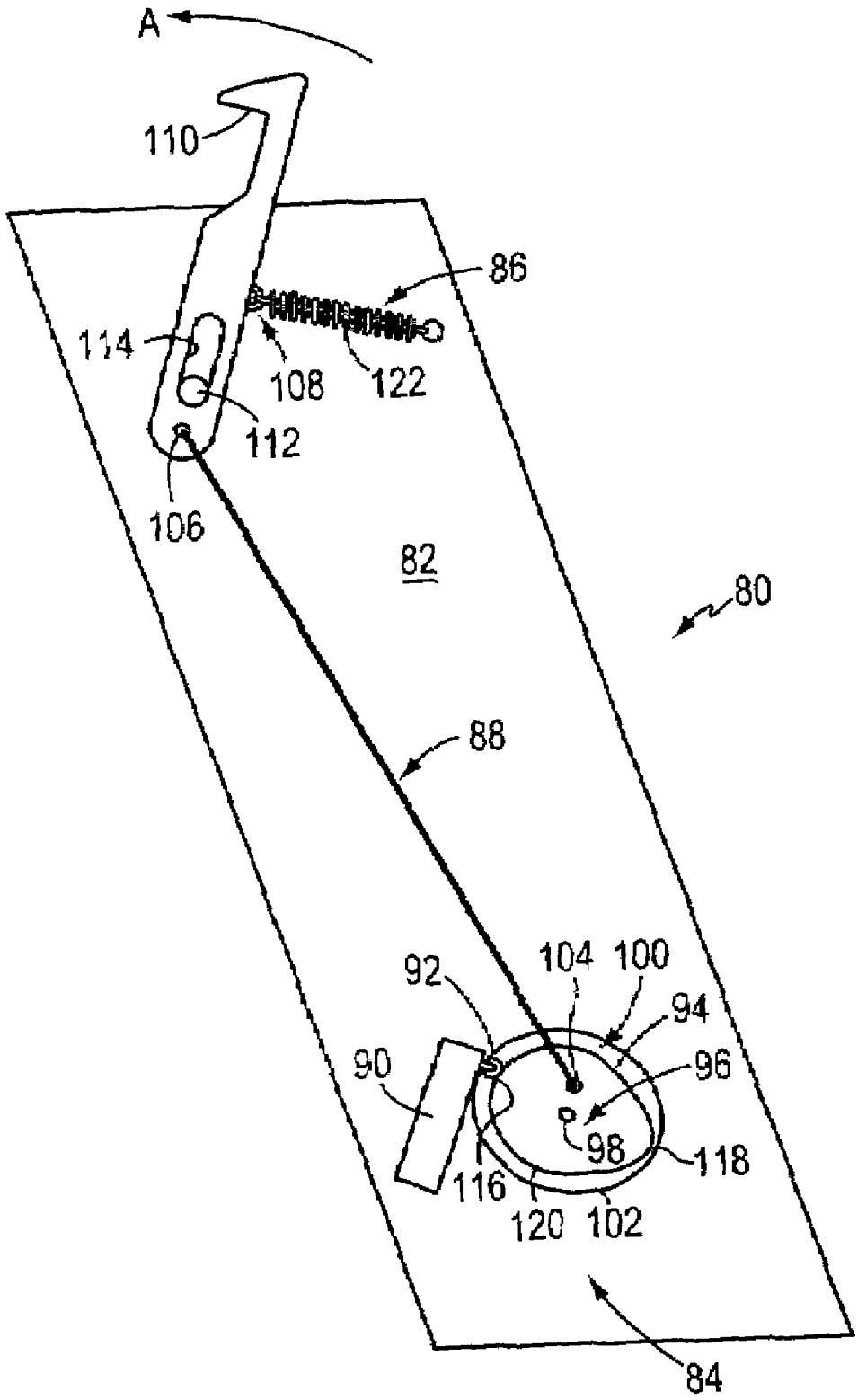
FIG. 7 illustrates a top plan view of another embodiment of the door latch of the present invention in an unlocked or open position.

Referring to FIG. 7, the unlatched or door released position is illustrated for a further embodiment of a door latch 80 of the present invention. While the door latch 30 is placed generally in the central location 26 at the front of the oven 10 adjacent the door 20, such location is hotter than a more remote location at the rear of the oven 10, which allows the components of the door latch 80 to be cheaper, since they have a lesser heat rating than the components of the door latch 30. To accomplish this more preferable location, the latch 80 is still desired to latch the door 20 in the slot 36 in the central location 26. The active motor and switch elements however are located in a back location of the oven 10 indicated by the dashed line 82, in FIGS. 3 and 4. The latch 80 again includes similar elements to the single switch embodiment just described with respect to the switch 70.

The latch 80 however includes an enlongated plate or frame 82, such as formed from sheet metal with ribs or upraised edges for structural strength (not illustrated). This allows an active element end 84 to be mounted in the cooler temperature location 82 and a passive element end 86 to be mounted in the front latch location 26. Also, preferably the plate 82 is mounted at an angle across the oven 10 as illustrated in FIGS. 4 and 7. The latch 80 then includes an elongated arm 88 to connect the operative elements in the two locations 26 and 82. The end 84 includes a switch 90 similar in function to the switches 64 and 70, but having a lower temperature rating. The switch 90 includes an activation pin 92, here shown activated by a cam surface 94 of a cam 96, all similar to the same components in the latch 30. The cam 96 is mounted to a shaft 98 of a motor 100 mounted on the opposite side of the plate 82 adjacent an aperture or opening 102.

The arm 88 is pivotably mounted to the cam 96 at a first end 104 and at a second end 106 to a lock arm 108. The lock arm 108 has a hook 110 which latches to the edge 48 in the slot 36 as the arm 108 is rotated in a direction A, in the same manner as the hook 42 of the lock arm 38. The lock arm 108 is pivotally mounted to the plate 82 by a pin or bolt 112. The lock arm 108 also includes a clearance slot 114, which allows the arm 108 to move relative to the pin 112 as the arm 88 rotates the arm 108.

In the latch 80 embodiment, as illustrated in FIG. 7, the self-clean operation again can be accomplished with only the one switch 90. In this embodiment, when the self-clean operation is initiated, the lock arm 108 is moved into the locked position by the arm 88 by the rotation of the motor 100 (which in this embodiment is counter-clockwise). The control panel 24 monitors the switch 90 and the actuation pin 92. The pin 92 is depressed by a leading edge 116 of the elongated cam surface 94 to activate the switch 90 at the end of a self-cleaning operation. The cam 96 rotates counter clockwise when the self-clean operation is initiated. As the arm 88 is moved by the rotation of the cam 96, the switch remains activated and the latch or lock arm 108 rotates in the direction A until it locks the door 20 shut by engaging the hook 110 with the edge 48 of the slot 36. The locking movement of the latch 80 is completed at the same time as a trailing edge 118 of the cam surface passes the pin 92 and then the switch 90 is de-activated signalling the control panel 24 that the hook 110 is engaged with the slot edge 48 and the door 20 is locked for the self-cleaning operation. The open position also is monitored by the control panel 24 by the state of a switch 90. When the self-clean operation is terminated the door latch 80 is released. The cam 96 is rotated again past a cam surface 120 between the edges 116 and 118, which does not engage the pin 92. Once the pin 92 is re-activated by the cam surface 94 at the leading edge 116 as the motor 50 rotates, then the pin 92 is depressed and the switch 90 is activated signalling the control panel 24 that the hook 110 is released from the slot edge 48 and the door 20 is open for regular operation of the oven 10. The lock arm 108 can include a bias spring 122 to aid in the rotation of the arm 108.

Having thus generally described the present invention, the same will become better understood from the appended claims in which the present invention is set forth in a non-limiting manner.

What is claimed is:

1. A cooking apparatus, comprising:

an oven chamber which can be heated for a self-cleaning operation;

an oven door movably opening and closing said chamber;

a motor drivingly attached to an oven door latch for locking and unlocking said oven door;

a monitor device for monitoring the position of said oven door latch; and a pulse device associated with said motor and said monitoring device for pulsing said motor between a first condition where said motor is excited into operation and a second condition where said motor is idle when said monitor indicates said oven door latch is not in the proper locking and unlocking position, said pulse device configured to, in response to a respective signal from said monitoring device indicating that said oven door latch is not in the proper locking and unlocking position, to repeatedly pulse said motor until said latch is in the proper locking and unlocking position as indicated by said monitoring device.

2. The apparatus as claimed in claim 1, wherein said motor is an asynchronously driven motor.

3. The apparatus as claimed in claim 1, wherein said motor is drivingly attached to said oven door latch by a lock arm including a hook which engages and locks said oven door when said self-cleaning operation is initiated.

4. The apparatus as claimed in claim 3, wherein said lock arm and said hook are driven by a rotatable cam coupled to said motor and the position of said cam is monitored by said monitor device to determine the position of said oven door latch.

5. The apparatus as claimed in claim 4, wherein said cam is monitored by the activation and deactivation of at least one switch which is engaged by a cam surface on said cam during at least a portion of said cam rotation.

6. The apparatus as claimed in claim 4, wherein said cam is monitored by the activation and deactivation of a pair of switches, each of which is engaged by a cam surface on said cam during at least a portion of said cam rotation to indicate the position of said oven door latch.

7. The apparatus as claimed in claim 3, wherein said motor and said oven door latch are adjacent said oven door.

8. The apparatus as claimed in claim 3, wherein said motor is located remotely spaced from said oven door and said oven door latch is located adjacent said oven door with an elongated arm coupling said motor to said oven door latch.

9. A cooking apparatus, comprising:

an oven chamber which can be heated for a self-cleaning operation;

an oven door movably opening and closing said chamber;

an asynchronously driven motor drivingly attached to an oven door latch for locking and unlocking said oven door;

said motor drivingly attached to said oven door latch by a lock arm including a hook which engages and locks said oven door when said self-cleaning operation is initiated;

a monitor device for monitoring the position of said oven door latch; and a pulse device associated with said motor and said monitoring device for pulsing said motor between a first condition where said motor is excited into operation and a second condition where said motor is idle when said monitor indicates said oven door latch is not in the proper locking and unlocking position, said pulse device configured to, in response to a respective signal from said monitoring device indicating that said oven door latch is not in the proper locking and unlocking position, to repeatedly pulse said motor until said latch is in the proper locking and unlocking position as indicated by said monitoring device.

10. The apparatus as claimed in claim 3, wherein said lock arm and said hook are driven by a rotatable cam coupled to said motor and the position of said cam is monitored by said monitor device to determine the position of said oven door latch.

11. The apparatus as claimed in claim 10, wherein said cam is monitored by the activation and deactivation of at least one switch which is engaged by a cam surface on said cam during at least a portion of said cam rotation.

12. The apparatus as claimed in claim 10, wherein said cam is monitored by the activation and deactivation of a pair of switches, each of which is engaged by a cam surface on said cam during at least a portion of said cam rotation to indicate the position of said oven door latch.

13. The apparatus as claimed in claim 9, wherein said motor and said oven door latch are adjacent said oven door.

14. The apparatus as claimed in claim 9, wherein said motor is located remotely spaced from said oven door and said oven door latch is located adjacent said oven door with an elongated arm coupling said motor to said oven door latch.

15. A method of locking a cooking apparatus, comprising:

the apparatus including an oven chamber and heating said chamber for a self-cleaning operation;

opening and closing said chamber with a movable an oven door;

driving an asynchronously driven motor coupled to an oven door latch for locking and unlocking said oven door;

monitoring the position of said oven door latch to ensure that the door is locked in the closed position before starting said self-cleaning operation;

pulsing said motor when said monitor indicates said oven door latch is not in the proper locking and unlocking position; and repeatedly pulsing said motor responsive to said monitoring device until said latch is in the proper locking and unlocking position as indicated by said monitoring device.

16. The method as claimed in claim 15, including drivingly attaching said motor to said oven door latch by a lock arm including a hook and engaging and locking said oven door with said hook when initiating said self-cleaning operation.

17. The method as claimed in claim 16, drivingly rotating said lock arm and said hook by a cam rotatingly coupled to said motor and monitoring the position of said cam to determine the position of said oven door latch.

18. The method as claimed in claim 17, including monitoring said cam by engaging a cam surface on said cam with at least one switch and activating and deactivating said switch during at least a portion of said cam rotation.

19. The method as claimed in claim 17, including monitoring said cam by engaging a cam surface on said cam with a pair of switches and activating and deactivating each of said switches during at least a portion of said cam rotation for indicating the position of said oven door latch.

* * * * *